US007762047B2

(12) United States Patent
Stackley et al.

(10) Patent No.: US 7,762,047 B2
(45) Date of Patent: Jul. 27, 2010

(54) FOOD ARTICLE PACKAGING APPARATUS AND METHOD

(75) Inventors: Mark Anthony Stackley, St. Croix Falls, WI (US); Steve John Schult, Omro, WI (US); David Lawrence Zuleger, Kaukauna, WI (US); Kenneth Eugene Nowak, Green Bay, WI (US)

(73) Assignee: Curwood, Inc., Oshkosh, WI (US)

( * ) Notice: Subject to any disclaimer, the term of this patent is extended or adjusted under 35 U.S.C. 154(b) by 133 days.

(21) Appl. No.: 11/358,178

(22) Filed: Feb. 21, 2006

(65) Prior Publication Data

US 2007/0193229 A1 Aug. 23, 2007

(51) Int. Cl.
*B65B 43/54* (2006.01)

(52) U.S. Cl. ..... 53/574; 53/449; 53/576

(58) Field of Classification Search ..... 53/574, 53/576, 257, 571, 449
See application file for complete search history.

(56) References Cited

U.S. PATENT DOCUMENTS

| | | | | |
|---|---|---|---|---|
| 3,945,171 | A | 3/1976 | Marietta, Jr. et al. | |
| 3,959,951 | A | 6/1976 | Paules | |
| 4,144,693 | A | 3/1979 | Ogata | |
| 4,183,194 | A * | 1/1980 | Lucke | 53/571 |
| 4,219,989 | A * | 9/1980 | Andrews | 53/572 |
| 4,241,562 | A * | 12/1980 | Meyer | 53/438 |
| 4,306,399 | A * | 12/1981 | Tsujimoto et al. | 53/52 |
| 4,495,751 | A | 1/1985 | Galbiati | |
| 4,672,793 | A * | 6/1987 | Terlizzi et al. | 53/434 |
| 5,483,784 | A * | 1/1996 | Owensby et al. | 53/459 |
| 5,618,252 | A | 4/1997 | Melville | |
| 5,816,990 | A | 10/1998 | Melville | |
| 5,885,150 | A | 3/1999 | Whittlesey | |
| 6,044,622 | A | 4/2000 | Brady et al. | |
| 6,672,038 | B2 * | 1/2004 | McGrane et al. | 53/570 |
| 6,871,676 | B2 | 3/2005 | Sus et al. | |
| 2003/0145560 | A1 | 8/2003 | Melville | |
| 2006/0059868 | A1 | 3/2006 | Melville | |

* cited by examiner

*Primary Examiner*—Sameh H. Tawfik
(74) *Attorney, Agent, or Firm*—Tom J. Hall

(57) ABSTRACT

Packaging apparatus and method for inserting food articles into a bag of comparable size. The apparatus has a conveyor that orients the product along a longitudinal axis and delivers the food article to a tray disposed below the conveyor so the product drops from the conveyor and onto the tray. The tray and conveyor move at speeds selected so the product maintains its longitudinal orientation as it drops from the conveyor into the product tray. A bag scoop holds the bag mouth open while the tray carrying the product advances into the bag. A product stripper moves into a position behind the bagged product after passage of the tray so that when the tray returns to its start position, the stripper butts against the end of the product and holds the product while the tray slides out of the bag.

15 Claims, 5 Drawing Sheets

FOOD ARTICLE PACKAGING APPARATUS AND METHOD

BACKGROUND OF THE INVENTION

The present invention generally relates to a packaging apparatus and method for packaging food articles. In particular, the invention relates to an apparatus and method for packaging elongated food articles such as cuts of various meat products.

DESCRIPTION OF RELATED ART

Many food products such as primal and sub-primal cuts of meat generally are packaged in vacuum-sealed plastic bags. Since boneless cuts of meat are particularly difficult to package due to their length and flaccid nature, applicant will discuss by way of example, that type of package, but the invention will be recognized by those skilled in the art as applicable to many other food products. For example, a single or multilayer thermoplastic film may be made into bags by a food packaging manufacturer using film stock comprising a tubular film or one or more flat sheets or webs of film by well known processes involving e.g. cutting, folding and/or sealing the film to form bags which may then be shipped to processors for use in food packaging operations. A typical bag produced from a tubular film stock will have one or two sides which have been heat sealed by the bag manufacturer in the bag forming process. Such bags will have one open side to allow the food processor to insert the food product into the bag. The food processor then makes the final seal thereby enclosing the food product. This final seal may follow gas evacuation of the bag by vacuum means or replacement of the gaseous environment within the bag by a particular gas or mixture of gases which may be inert or reactive with the enclosed product to provide some advantage such as to assist product preservation. This final seal is frequently a heat seal similar to the initial seals produced by the bag manufacturer although the actual heat sealing equipment may vary. Generally, heat sealing of thermoplastic film is accomplished by applying sufficient heat and pressure to adjacent film layer surfaces for a sufficient time to cause a fusion bond between the layers. A common type of seal used in manufacturing bags is known to those skilled in the art as a hot bar seal. In making a hot bar seal, adjacent thermoplastic layers are held together by opposing bars of which at least one is heated to cause the adjacent thermoplastic layers to fusion bond by application of heat and pressure across the area to be sealed. For example, bags may be manufactured from a tube stock by making one hot bar seal transverse to the tube. This seal may also be referred to as a bottom seal. Once the bottom seal is applied, the tube stock may be transversely cut to form the mouth of the bag. Once a food product such as meat or poultry is inserted into the bag, the package is typically evacuated and the bag mouth sealed. At one time, the standard method for sealing a bag was to fasten a clip around the mouth of the bag. More recently, heat sealing techniques have been employed to seal the bag. For example, a bag mouth may be hot bar sealed or it may be sealed by another common type of heat seal known as an impulse seal. An impulse seal is made by application of heat and pressure using opposing bars similar to the hot bar seal except that at least one of these bars has a covered wire or ribbon through which electric current is passed for a very brief time period (hence the name "impulse") to cause the adjacent film layers to fusion bond. Following the impulse of heat the bars are cooled (e.g. by circulating coolant) while continuing to hold the bag inner surfaces together to achieve adequate sealing strength. Generally, impulse seals may be made faster than hot bar seals because of the quick cool down of the impulse ribbon following the heat impulse. Impulse seals are also generally narrower than hot bar seals which lead to an improved package appearance, but narrower seals also leave smaller margin for error in the production of continuous sealed edges. Since typically less area is bonded in an impulse seal relative to a hot bar seal, the performance of the sealing layer of the thermoplastic film is more critical. Other techniques can also be used to hermetically seal the bags such as adhesives, ultrasonic sealing or other well known methods. After packaging, the bags undergo a heat shrinking process by immersion in hot water (about 80-90° C.) causing the bag to shrink tightly about the food product.

Elongated food articles, such as cuts of meat which include, but are not limited to, boneless pork loins and beef tenderloins are particularly difficult to package. These long boneless cuts are packaged in elongated bags having a size comparable to the cut of meat in that the bag has a relatively small diameter as compared to the length of the bag. These cuts of meat are not rigid but are relatively flaccid in that they droop if supported from only one end. The non-rigid nature of these long boneless cuts makes it difficult to insert them into the narrow bag opening using automatic loaders. This is because the cuts do not maintain a longitudinal orientation when pushed along a work surface and into a bag. Pushing on an end of such non-rigid cut of meat to move it along a work surface tends to cause the cut to snake or fold back on itself as it moves across the work surface. Friction and the flaccid nature of the cut of meat prevents the end of the cut, away from the pusher, from moving relative to the work surface while the end against the pusher moves relative to the work surface.

The flaccid nature of these cuts of meat tends to make packaging them labor intensive. In this respect, the packaging of boneless pork loins and whole beef tenderloins generally is handled by two packers. One holds the narrow mouth of a bag open while the other retrieves the food article from a feed conveyer or pile and drops it into the bag. Pork loins, beef tenderloins and like products are inherently slippery, this together with the length and the non-rigid nature of the product, makes the product difficult to handle.

Also, the very act of manually handling the food article is a possible source of contamination. Should the product slip from the operator's hand and drop on a floor surface, there is a further danger of contamination. Any dropped product either is repackaged as a second or is used as scrap. Accordingly, due to the length, slipperiness and non-rigid nature of the product, the manual bagging process is time-consuming, messy, inefficient and prone to cross-contamination.

Another problem with loading these cuts of meat by hand is that the internal surface area of the bag adjacent the bag mouth often is contacted by the meat passing into the bag. Blood, fat and/or meat juices from the product transfer to the inner edges of the bag mouth as the product enters the bag. These materials contaminate the inner surfaces (the sealant side) of the bag and compromise the heat sealing operation so that an effective hermetic heat seal closure of the bag cannot be made. The result is a heat seal that is incomplete so the seal fails to hold a vacuum. Even if a complete heat seal is made, the contamination can result in a weak seal that fails when the bag is subjected to the stress of heat shrinking. Even worse, a weak seal that survives heat shrinking of the bag may fail when the bag is subjected to the rigors of handling and shipping.

If the defective seal is discovered prior to shipment, the resultant "leakers" or "low vacuum" bags are reworked by opening the bag, removing the meat, re-bagging it and recycling the product through the evacuation and sealing equipment. A seal that survives the shrinking process but is so weak that it subsequently fails (such as during shipping), considerably compromises the protection against contamination offered by the bag and shortens the storage or shelf life of the product.

One attempt to speed up the bagging operation involves the use of a funnel. Here, an operator places a bag over a drop chute, which basically is a funnel device. After the bag is placed over the drop chute, another operator will drop the elongated cut of meat into the chute which feeds the meat into the bag. While the use of a drop chute tends to keep the sealing surfaces of the bag free of contamination, the loading process still is labor intensive and requires direct contact between the operator and the food article.

Accordingly, an object of the present invention is a packaging apparatus and method for bagging a food article, which includes, but not limited to, for example, elongated boneless cuts of meat such as boneless pork loins, beef tenderloins and the like that minimizes manual handling of the food article and reduces the likelihood of contamination of the food article.

Another object is to provide such a packaging apparatus and method that reduces the likelihood that the seal area of the bag is contaminated by the packaging process thereby reducing the instances of incomplete or weak heat seals and poorly evacuated bags.

Another object of the invention is to provide an apparatus and method that reduces the likelihood of employee repetitive motion injuries and associated expense through the reduction in direct product handling.

A further object is to provide such an apparatus and method that increases productivity by reducing the likelihood of dropping either a bag or the food article during the bagging process and reduces the need for reworking or re-bagging the product.

BRIEF SUMMARY OF THE INVENTION

In the present invention, food articles, including, but not limited to, boneless pork loins, beef tenderloins and the like, are bagged in a completely automated process that reduces or even eliminates the problem of contamination of both the food article and the seal area of the bag. Contamination by manual handling is minimized by limiting operator contact with the food article. This is accomplished, in part, by moving the product onto an infeed conveyor belt using a meat hook. Once on the infeed conveyor, the product is oriented in transit so that its longitudinal axis is straight and generally parallel to the direction of conveyor travel.

The infeed conveyor moves the product to a receiving station where the product is laid into a product tray in a manner that maintains the product orientation. In this respect, the product tray is disposed below the conveyor and moves at a selected speed relative to the speed of the conveyor. The speed of the product tray is selected so that an elongated food article that drops from the end of the conveyor is laid into the moving product tray without disturbing the longitudinal orientation of the product. Preferably, the speeds of conveyor and product trays are coordinated to move at substantially the same speed. However, it should be understood that for design or operational considerations. it may be necessary to move the product tray slightly faster or slower than the conveyor to ensure that the longitudinal orientation of the elongated product is maintained.

As the food article is being laid into the product tray, an elongated bag is moved into a position at a bag loading station downstream of the product tray. At the bag loading station, air is directed at the relatively narrow bag mouth to open the bag. A bag scoop then moves into the bag and expands radially to hold the relatively narrow bag mouth open at the bag loading station. The presence of the bag scoop in the bag mouth protects the bag seal area and prevents contamination of the bag seal area by contact with the food article passing into the bag.

With the bag mouth held open by the bag scoop, the product tray and its contents are advanced to a downstream product delivery station. The path of travel of the product tray to the product delivery station passes through the bag scoop at the bag loading station so that both the product tray and the food article on the tray pass into the bag. As the product tray continues to advance from the bag loading station towards the delivery station, the product tray engages the bottom of the bag and strips the bag off the bag scoop. Movement of the product tray continues to the delivery station so that a space is created between the open end of the bag and the bag scoop.

Once the bag is removed from the bag scoop, a stripper moves transversely into a position behind the product. The direction of the product tray is reversed so that the bag and its contents are carried against the stripper. The stripper stops the return movement of the bag and its contents while the product tray continues its return motion. This causes the bag and the food article within the bag to slide off of the product tray and onto an outfeed conveyor. The outfeed conveyor then conveys the bagged product to a conventional heat sealing station where the bag is evacuated and the bag mouth is heat sealed.

Accordingly, the apparatus of the present invention may be characterized in one aspect thereof by an apparatus for packaging food article comprising:

a) a longitudinal frame having an inlet end, an outlet end, a product receiving station, a bag loading station and a product delivery station;

b) wherein the longitudinal frame comprises a means to transport at least one food article thereon comprising a food article receiving end and a food article discharge end;

c) wherein the product receiving station comprises a horizontal product tray having a longitudinal axis and adapted to receive the food article from the food discharge end; wherein the product tray is adapted to both deliver the food article into a flexible bag and retract from the flexible bag; wherein the product receiving station is adapted to position the food article such that the longest dimension of the food article has an orientation substantially parallel to the longitudinal axis of the product tray when the food article is received onto the product tray; and d) wherein the bag loading station is adapted to receive and open the flexible bag; and e) wherein the product delivery station comprises a means for the food article to remain in the flexible bag when the product tray is retracted from the flexible bag.

In its method aspect, the present invention may be characterized by a method for packaging a food article comprising:

a) orienting a food article on a moving conveyor with the product longitudinal axis extending along the conveyor longitudinal axis;

b) moving a product tray below the conveyor in the direction of the conveyor longitudinal axis;

c) laying the food article from an end of the conveyor and into the product tray while moving the conveyor and the product tray at a speed selected to maintain the longitudinal orientation of the product; and thereafter d) bagging the elongated food article.

DETAILED DESCRIPTION OF THE DISCLOSURE

Figure 1:
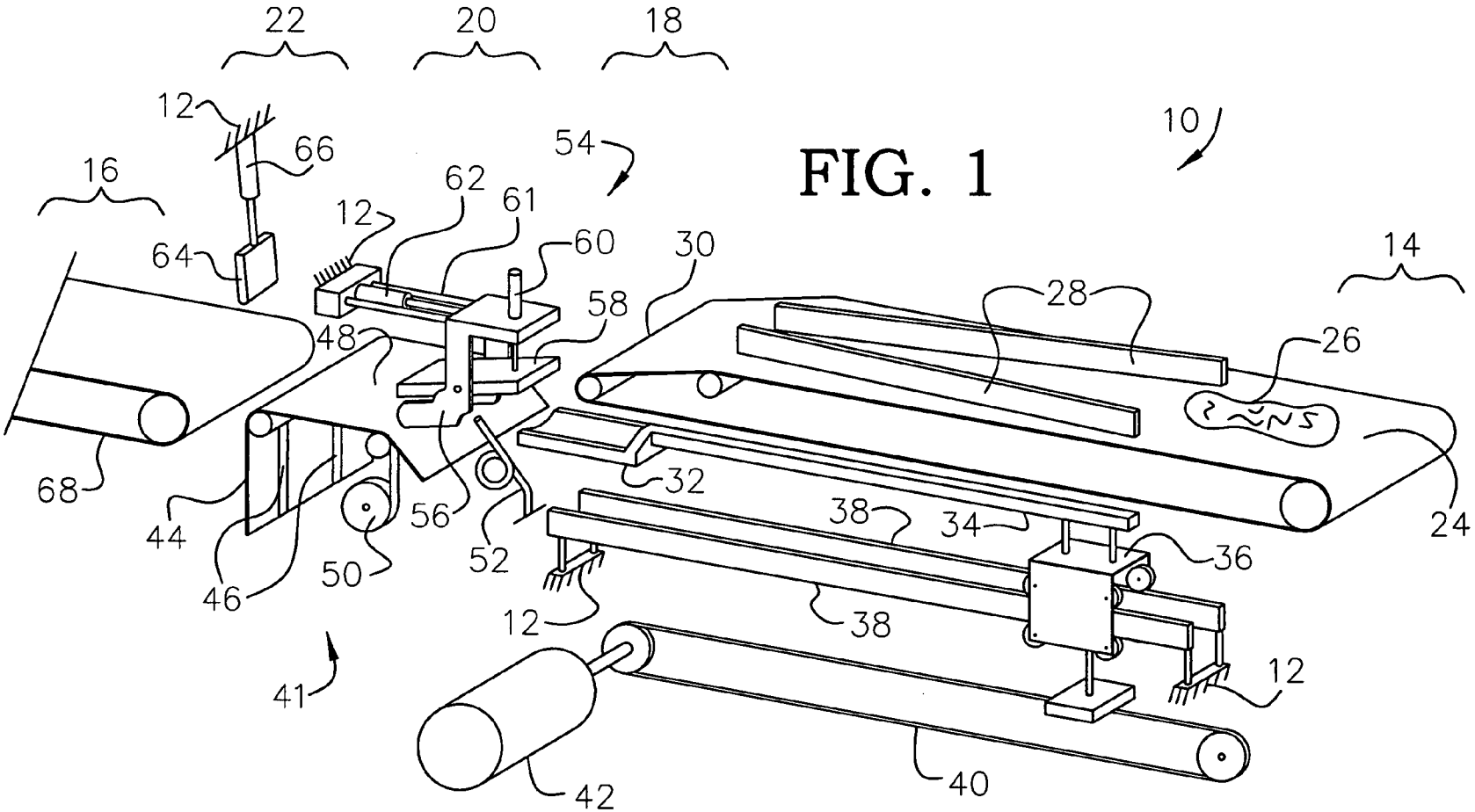
FIG. 1 is a perspective view showing components of the apparatus of the present invention at a start position.

Referring to the drawings, FIG. 1 shows the apparatus of the present invention generally indicated at 10. The apparatus includes a frame, portions of which are shown at 12. The frame is arranged along an elongated axis from an inlet end 14 to an outlet end 16 and includes an upstream product receiving station 18, an intermediate bag loading station 20 and a downstream product delivery station 22.

Disposed on the frame is an infeed conveyor 24 arranged to deliver a food article 26 to the receiving station 18. The food article is an elongated flaccid muscle such as a boneless pork loin, beef tenderloin or the like, Associated with the conveyor are elongated upright product guides 28 that extend in the conveyor direction. The guides 28 are spaced apart and converge towards the receiving station 18. Accordingly, an elongated food article 26 on the conveyor and feeding into the space between the guides, while in transit, assumes an axial alignment relative to the longitudinal axis of the frame at the delivery end 30 of the conveyor.

Beneath the conveyor is a product tray 32. The product tray is long enough to accommodate the full length of the food article and is an extension of an arm 34. The arm is attached to a carriage 36 that rides on a pair of rails 38. The carriage, in turn, is connected to a timing belt 40 driven by a motor 42. The motor and timing belt provide a drive means for moving the carriage along the rails such that the product tray 32 passes through the bag loading station 20 when moving between the upstream receiving station 18 and the downstream product delivery station 22.

Located at the bag loading station 20 is a taped bag feeder generally indicated at 41. The bag feeder is conventional and known in the art. It is sufficient for purposes of the present invention to say that the bag feeder 41 includes a supply of imbricated bags 44 releaseably held by at least two strands of tape 46 equally spaced from the center of the bag. A mechanism in the bag feeder pulls the tape to draw the bags one after another from a carton (not shown) and across a table 48 with the bag mouth oriented towards the inlet end 14. Individual bags are removed from the tape and the spent strands of tape are wound on take-up reels 50 (only one being shown). While the bag is on the table, one or more air nozzles 52 each directs a stream of air towards the bag mouth to open the bag held on the tape.

Suspended over the table 48 and the taped bag feeder 41 is a bag scoop device generally indicated at 54. The bag scoop device is oriented facing the outlet end 16 and includes spaced opposite scoop pans 56 (only one shown in FIG. 1). A scoop flap 58 is pivotally connected in the space between the pans. A vertically-oriented pneumatic cylinder 60 carried by the scoop device operates the flap in that extension of the cylinder moves the downstream end of the flap upwardly and the retraction of the cylinder depresses the downstream end of the scoop flap to the position shown in FIG. 1.

The bag scoop device 54 is connected to a pair of linear shafts 61 and is activated by a pneumatic cylinder 62 grounded to the frame 12. Operation of the cylinder 62 moves the linear shafts and the bag scoop 54 in a direction towards and away from the outlet end 16. In this respect a full extension of the cylinder 62 locates the bag scoop towards the inlet end 14 or to the right as viewed in FIG. 1. Retraction of the cylinder 62 moves the bag scoop 54 and the linear shafts in two steps to the left as viewed in FIG. 1. There first is movement to an intermediate position that locates the bag scoop over the table 48 and then there is movement to an end position that locates the bag scoop farther towards the left.

Completing the structure at the product delivery station 22 are a product stripper 64 attached to a vertically oriented pneumatic cylinder 66 that is grounded to the frame 12 and an outfeed conveyor 68.

In operation, an operator simply lays the elongated food article 26 on the infeed conveyor 24. As noted above, the food article is elongated and flaccid in that it has little or no longitudinal rigidity. For example, if one end is lifted, the opposite end would remain on the conveyor; if one end is pushed longitudinally, the opposite end might not move and the product would simply bend to a C-shape or S-shape. The intent is to package the product in an elongated bag that has a diameter not much greater than the food article. Accordingly, the food article must be longitudinally aligned with the bag and delivered axially into the bag.

Longitudinal alignment is started by the guides 28. In this respect, the conveyor 24 carries the food article between the guides 28 and towards the product receiving station 18. As the food article is carried through the ever narrowing space between the guides, the guides center the product and urge it to an orientation aligned along the longitudinal axis of the frame 12.

Figure 2:
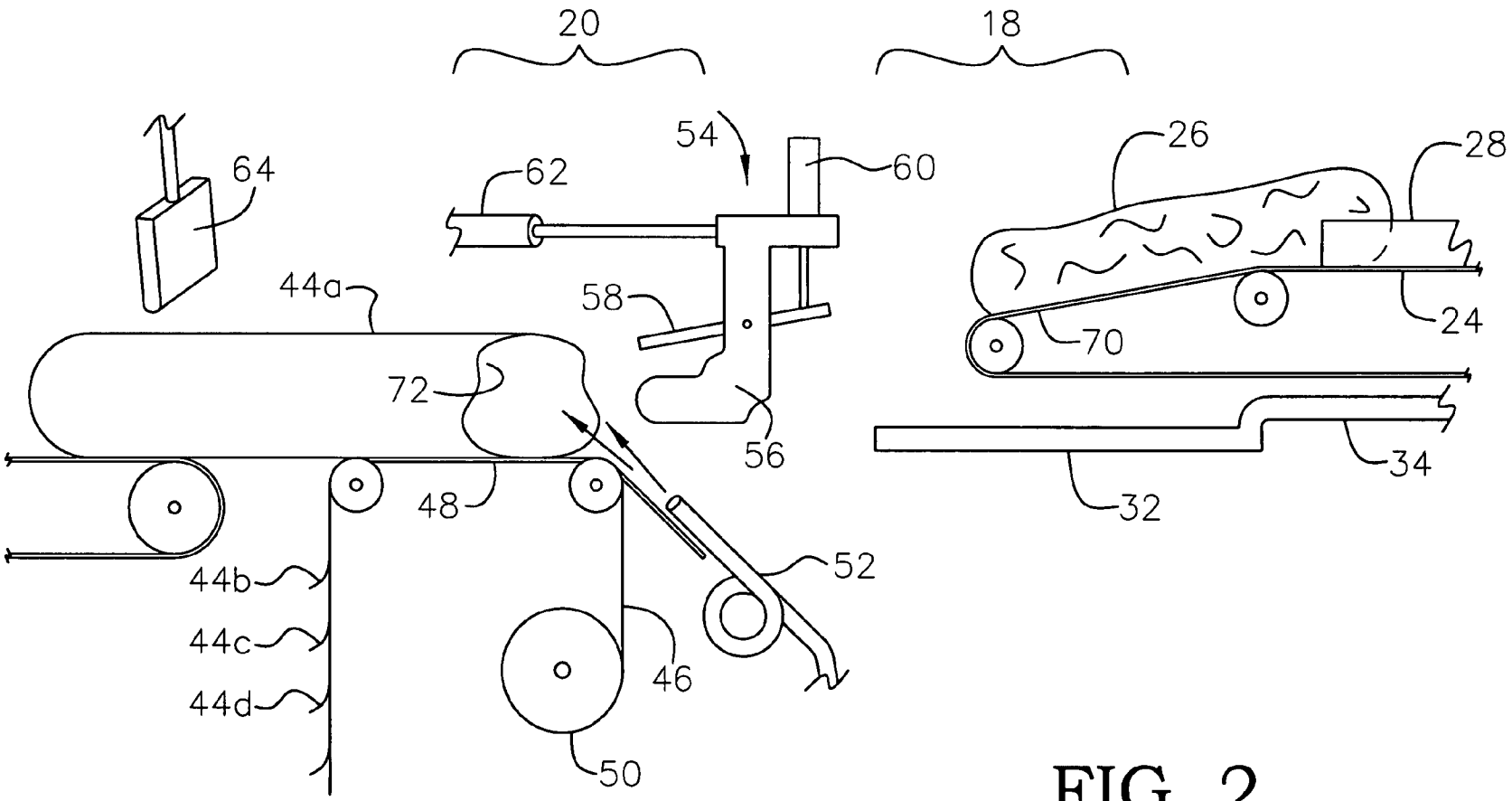
FIG. 2 is a view similar to FIG. 1 only showing selected components on a larger scale at a later stage of operation.

FIG. 2 shows the food article 26 emerging from between the guides 28 at the outlet end 70 of the conveyor 24. The outlet end is inclined so that the food article begins a decent down the incline. FIG. 2 also shows the product tray 32 in its home position located directly below the inclined outlet end 70 and extending slightly out from under the end of the conveyor.

As also shown in FIG. 2, an elongated bag 44*a* is disposed across the table 48 at the bag loading station 20. The bag 44*a* is one of a number of conventional imbricated bags 44*b*, 44*c*, etc., releaseably adhered to tapes 46 as described above. In a conventional manner, the bags are drawn from a bag supply (not shown) by pulling tapes 46 with the tape take-up reels 50 (only one being shown). As a first bag 44*a* is advanced across the table, the take-up reels stop. At some point, preferably while the product tray is at its home position, a stream of air from the air nozzle 52 strikes the bag mouth 72 and the bag opens.

Figure 4:
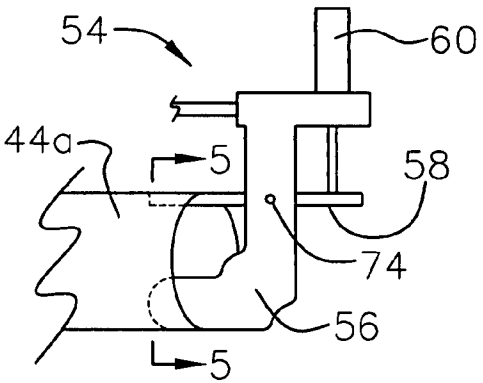
FIGS. 3 and 4 are views showing steps in the bag opening operation.
Figure 5:
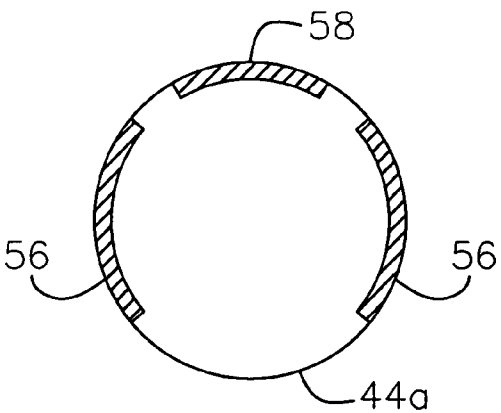
FIG. 5 is a view taken along lines 5-5 of FIG. 4.
Figure 3:
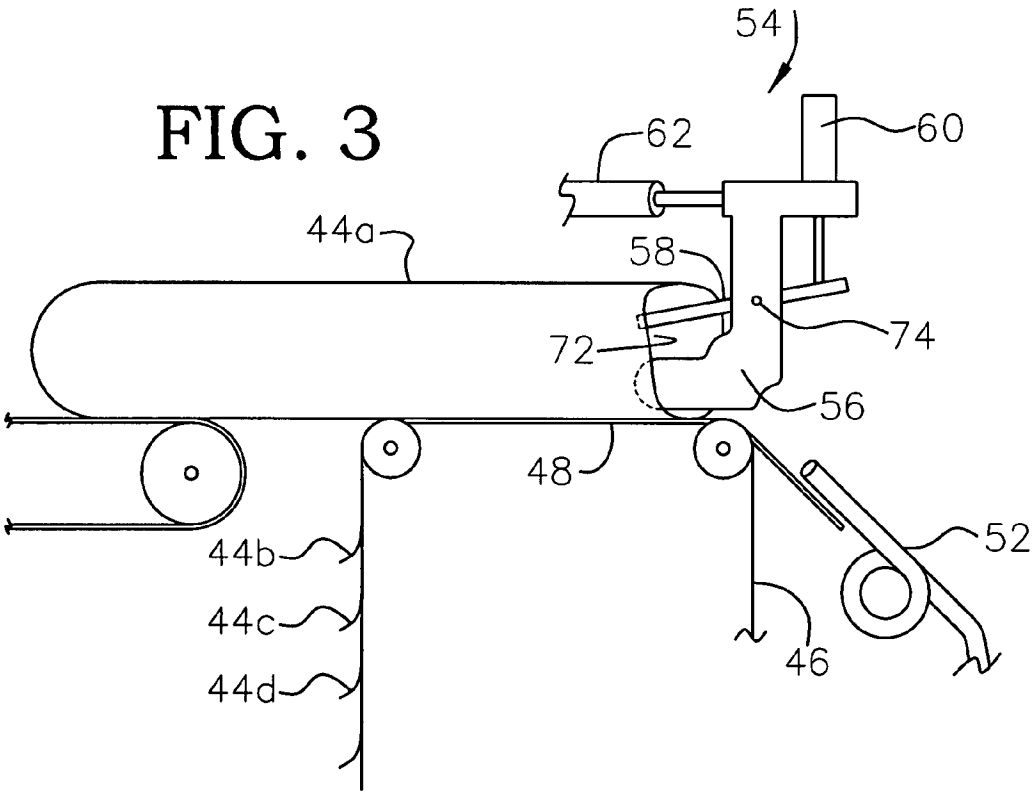

With the bag mouth open, cylinder 62 is operated to retract the cylinder for part of its stroke so as to draw the bag scoop device 54 linearly to the left to an intermediate position. This carries the two scoop pans 56 and the scoop flap 58 into the open mouth of the bag (FIG. 3). Once in this position, the scoop flap cylinder 60 is activated to rotate the scoop flap 58 about a pivot connection 74 to the position shown in FIG. 4. When pivoted to the FIG. 4 position, the scoop flap engages and stretches the bag mouth about the scoop pans 56 to a full open position (FIG. 5). Stretching the bag mouth allows the bag scoop device to apply a holding grip to the inside of the bag. The scoop pans and scoop flap also protect the inner surface of the bag mouth from contact with the food article as further described hereinbelow.

After the bag mouth is firmly gripped and opened by the bag scoop device 54, cylinder 62 is retracted farther to the left for the remainder of its stroke. This pulls the bag 44*a* off the tape 46, and the taped bag feeder 41 is again activated to draw the next bag 44*b* across the table 28.

As noted above, the operating cycle of the product tray 32 begins when the food article is detected at the end of the infeed conveyor. At this point the product tray is in its home position as shown in FIG. 2 located beneath and extending slightly out from under the end of the conveyor 24. Sensors (not shown) are located to detect when the product tray is at its home position beneath the end of the conveyor. The infeed conveyor is activated to advance a product down the inclined portion 70 and off the infeed conveyor. As the product advances down the inclined portion of the conveyor, the motor 42 is activated. This moves the timing belt 40 so as to drive carriage 36 to the left as viewed in FIG. 2, and this moves the product tray 32 towards the product receiving station 18 as the product drops off the inclined portion of the conveyor.

Figure 6:
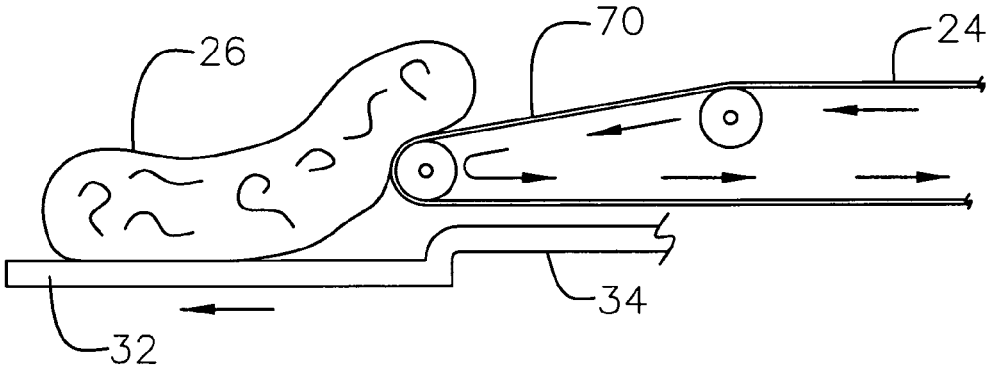
FIG. 6 shows a food article at a receiving station of the apparatus.

The forward motion of the carriage and the infeed conveyor movement preferably are selected so that as the food article drops off the conveyor, it is laid into the product tray without disturbing the longitudinal orientation of the food article. In this respect, the speed of the conveyor and product tray preferably are synchronized so the product tray 32 moves forward at substantially the same speed as the infeed conveyor and delivers the food article off the conveyor. In some cases, it may be necessary to move the product tray faster or slower than the conveyor to achieve this result. In any event, the result of the speed selection of the conveyor and product tray is that as the food article drops off the end of the conveyor, the product is laid into the product tray 32 in a manner that maintains the longitudinal orientation of the product as it is laid into the product tray (see FIG. 6).

Figure 7:
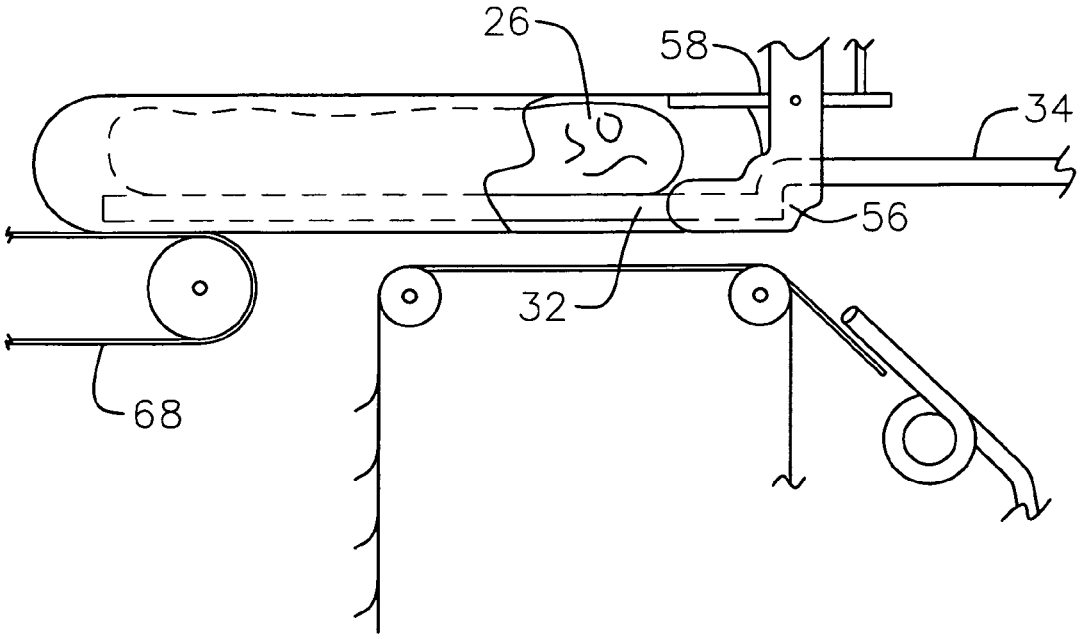
FIGS. 7-10 show steps of loading the food article into a bag.

The product tray 32 continues its forward motion after receiving the product until it (and the food article 26 on the tray) enter the bag that is being held open by the scoop pans 56 and scoop flap 58 as shown in FIG. 7.

As mentioned hereinabove, the position of the scoop pans and scoop flap protect the inside surface of the bag from contact with the food article entering the bag. As shown in FIG. 5, the scoop pans 56 and the flap 58 protect a large portion of the bag surface. The portion of the bag surface left exposed in FIG. 5 is towards the underside of the bag. However, this portion of the bag surface is protected by the product tray entering the bag. The inner surface of the bag adjacent to the bag mouth comprises the seal area of the bag so little or no portion of this seal area comes in contact with the food article. Accordingly, there is no contamination of this area by fat, blood or other meat juices. Since the seal area is left uncontaminated, the prospects for making a good heat seal are improved, and the likelihood of a poor or intermittent heat seal is reduced.

Figure 8:
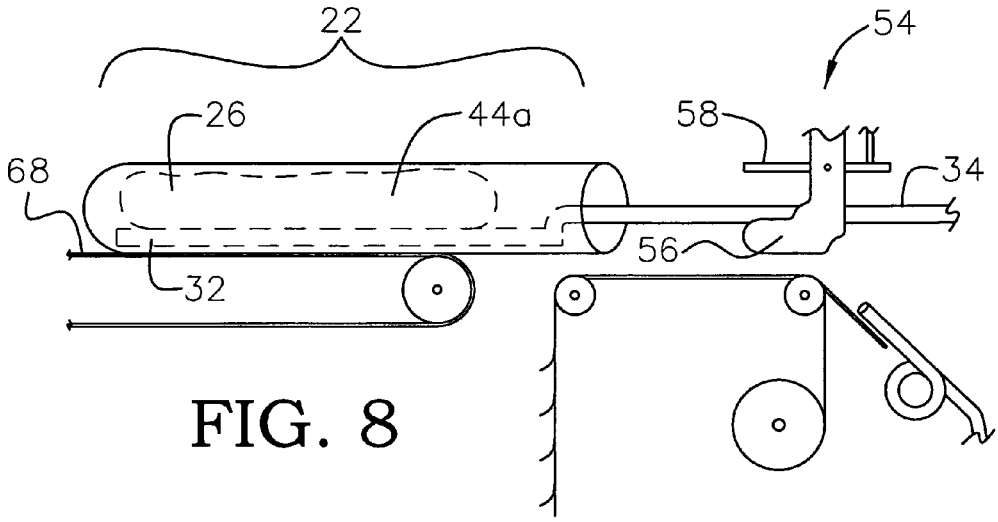

The product tray 32 continues to advance even after making contact with the closed end of the bag. This pulls the bag off the bag scoop device 54 as shown in FIG. 8 and delivers the bag and product to the product delivery station 22 over the outfeed conveyor 68. The forward advance of the product tray stops at this point.

Figure 9:
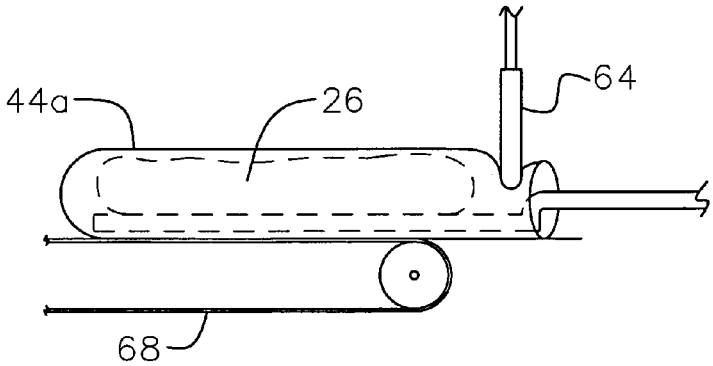
Figure 10:
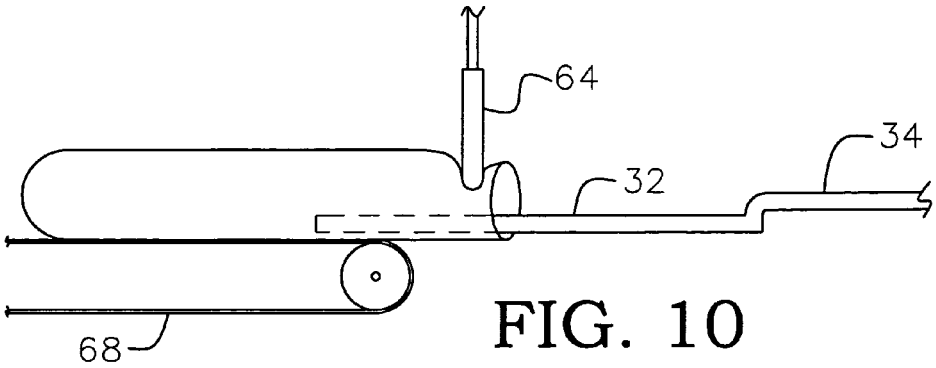

As shown in FIG. 9, the stripper 64 then is extended downward by the activation of the cylinder 66 (FIG. 1) into the product tray at a position behind the product 26. Once the stripper is in position, the carriage 36 is reversed by a change in direction of the drive motor 42. This draws the product tray 32 to the right as shown in the FIGS. 9-10. However, the location of the stripper 64 behind the product prevents the product and the bag from moving. The result, as shown in FIG. 10, is that the product tray 32 slides out from under the food article. This allows the bag and the food article within the bag, together referred to as the "bagged product," to be deposited on the outfeed conveyor 68.

As the product tray returns to its start position, the outfeed conveyor carries the bagged product to an evacuator/heat sealer (not shown). The cylinders 60 and 66 return to their home positions so the product stripper 64 and the scoop flap 58 are returned to the position as shown in FIG. 1. Cylinder 62 also returns the bag scoop device 54 to its home position.

At this point, the process repeats, and the next food article coming down the inclined portion of the conveyor is laid into the product tray. However, it should be noted that the next loading cycle should not commence until the previous cycle is complete; otherwise, the loading machine may jam. Accordingly, if a food article begins a decent down the inclined portion of the conveyor prior to the completion of a given loading cycle, a sensor (not shown) is located to detect the leading edge of a food article on the conveyor. If the leading edge is detected before the previous cycle is complete, the sensor will cause the conveyor to stop. This stoppage continues until an indication is received that the previous cycle is complete and the product tray is again at its home position.

Accordingly, it should be appreciated that the present invention accomplishes its intended objects in providing an apparatus and method for packaging elongated boneless pieces of meat such as boneless pork loins, beef tenderloins and the like that minimizes manual handling of the food article and reduces the likelihood of contamination of the food article. The packaging apparatus and method of the present invention operates to orient an elongated food article in the direction of its longitudinal axis and maintains this orientation while the product is transferred from an infeed conveyor to a product loading device that inserts the product into an elongated bag.

The apparatus and method further reduces the likelihood that the seal area of the bag will be contaminated by the packaging process, thereby reducing the instances of incomplete or weak heat seals or poorly evacuated bags. The present invention further increases productivity by reducing the likelihood of dropping either a bag or the food article when inserting the product into an elongated bag comparable in size to the food article. The invention also reduces the chance of repetitive motion injuries to workers.

The invention claimed is:

1. An apparatus for packaging food article comprising:

a) a longitudinal frame having an inlet end, an outlet end, a product receiving station, a bag loading station and a product delivery station;

b) wherein said longitudinal frame comprises a means to transport at least one food article thereon comprising a food article receiving end, and a food article discharge end;

c) wherein said product receiving station comprises a horizontal product tray having a longitudinal axis and adapted to receive said food article from said food discharge end; wherein said product tray is adapted to both deliver said food article into a flexible bag and retract from said flexible bag; wherein said product receiving station is adapted to position said food article such that the longest dimension of said food article has an orientation substantially parallel to said longitudinal axis of said product tray when said food article is received onto said product tray; and d) wherein said bag loading station is adapted to receive and open said flexible bag;

e) wherein said product delivery station comprises an outfeed conveyor and a vertically actuated stripper device adapted to engage said product tray at a position between said food article and the mouth of said flexible bag such that said food article remains in said flexible bag when said product tray is retracted from said flexible bag; and f) wherein said outfeed conveyor of said product delivery station and said bag loading station are positioned to lie on the same substantially horizontal plane such that said food article does not invert while being unloaded from said bag loading station to said outfeed conveyor.

2. An apparatus as in claim 1, wherein said means to transport at least one food article comprises a conveyor.

3. An apparatus as in claim 2, wherein said conveyor comprises a pair of longitudinal guides adapted to orientate said food article relative to said product tray when said food article is in transit from said food article receiving end to said food article discharge end.

4. An apparatus as in claim 1, wherein said product tray is adapted to pass through said bag loading station to said product delivery station.

5. An apparatus as in claim 1, wherein said bag loading station comprises a bag scoop device.

6. An apparatus as in claim 5, wherein said bag loading station further comprises a bag feeder device adapted to deliver individual bags to said bag scoop device.

7. An apparatus as in claim 1, wherein said food article comprises a meat product.

8. An apparatus as in claim 7, wherein said meat product is selected from the group consisting of beef, bison, pork, lamb, chicken, duck and turkey.

9. An apparatus for packaging food article comprising:

a) a longitudinal frame having an inlet end, an outlet end, a product receiving station, a bag loading station and a product delivery station;

b) wherein said longitudinal frame comprises a conveyor to transport at least one food article thereon comprising a food article receiving end and a food article discharge end;

c) wherein said product receiving station comprises a horizontal product tray having a longitudinal axis and adapted to receive said food article from said food discharge end; wherein said product tray is adapted to both deliver said food article into a flexible bag and retract from said flexible bag; wherein said product receiving station is adapted to position said food article such that the longest dimension of said food article has an orientation substantially parallel to said longitudinal axis of said product tray when said food article is received onto said product tray; and d) wherein said bag loading station is adapted to receive and open said flexible bag;

e) wherein said product delivery station comprises an outfeed conveyor and a vertically actuated stripper device adapted to engage said product tray at a position between said food article and the mouth of said flexible bag such that said food article remains in said flexible bag when said product tray is retracted from said flexible bag; and f) wherein said outfeed conveyor of said product delivery station and said bag loading station are positioned to lie on the same substantially horizontal plane such that said food article does not invert while being unloaded from said bag loading station to said outfeed conveyor.

10. An apparatus as in claim 9, wherein said conveyor comprises a pair of longitudinal guides adapted to orientate said food article relative to said product tray when said food article is in transit from said food article receiving end to said food article discharge end.

11. An apparatus as in claim 9, wherein said product tray is adapted to pass through said bag loading station to said product delivery station.

12. Apparatus as in claim 9, wherein said bag loading station comprises a bag scoop device.

13. An apparatus as in claim 12, wherein said bag loading station further comprises a bag feeder device adapted to deliver individual bags to said bag scoop device.

14. An apparatus as in claim 9, wherein said food article comprises a food article.

15. Apparatus as in claim 14, wherein said food article is selected from the group consisting of beef, bison, pork, lamb, chicken, duck and turkey.

* * * * *